US005518531A

United States Patent [19]

Joannu

[11] Patent Number: 5,518,531

[45] Date of Patent: May 21, 1996

[54] ION INJECTOR FOR AIR HANDLING SYSTEMS

[76] Inventor: Constantinos J. Joannu, 49 Mill Street, Apt. 4, Carleton Place, Canada

[21] Appl. No.: 238,507

[22] Filed: May 5, 1994

[51] Int. Cl.[6] ..... B03C 3/41

[52] U.S. Cl. ..... 96/55; 96/80; 96/94; 96/97; 361/226

[58] Field of Search ..... 96/94, 97, 80, 96/55, 57, 59, 65, 69, 70, 99, 96; 95/63, 69, 70, 78; 55/279, DIG. 39; 422/22, 120; 323/903; 361/226, 233

[56] References Cited

U.S. PATENT DOCUMENTS

| | | | |
|---|---|---|---|
| 1,995,790 | 3/1935 | Anderson | 96/97 X |
| 2,244,279 | 6/1941 | White | 96/96 |
| 3,706,182 | 12/1972 | Sargent | 96/55 |
| 4,244,710 | 1/1981 | Burger | 96/97 X |
| 4,304,096 | 12/1981 | Liu et al. | 96/55 X |
| 4,955,991 | 9/1990 | Torok et al. | 96/97 X |
| 5,034,032 | 7/1991 | Yikai et al. | 96/97 X |
| 5,364,458 | 11/1994 | Burnett et al. | 96/55 |

FOREIGN PATENT DOCUMENTS

| | | | |
|---|---|---|---|
| 553420 | 5/1943 | United Kingdom | 96/97 |

*Primary Examiner*—Richard L. Chiesa

[57] ABSTRACT

This invention relates to an ion generator capable of being mounted on an air duct and injecting ions in the air stream inside the duct for enhancing the performance of a filter downstream. The unit consists of a high voltage generator, a connector for connecting such generator to a low voltage source, one or more ionizing needles, and a clamp for attaching the unit to an air duct.

4 Claims, 1 Drawing Sheet

ION INJECTOR FOR AIR HANDLING SYSTEMS

FIELD OF THE INVENTION

This invention relates to air filtration systems. More particularly it relates to ionization mechanisms to improve the performance of filters.

BACKGROUND TO THE INVENTION

It is well known that particulate matter in the air can be filtered out more easily if the particles are charged. This invention provides for an ion generator which enables the charging of particulate matter in the air in an air duct and thus making any particulate matter in the air easier to capture by a filter downstream.

In previous art, ionizers in the form of thin wires or needles have been either part of an integral air cleaning system, or they were separate from the high voltage power supply, requiring high voltage connecting wires which made installation difficult.

It is an object of the present invention to provide an ion injector which is easy to install in an air handling system in order to improve the efficiency of a filter in the system.

Yet another object of the invention is to provide for a high voltage power supply which is an integral part of the injector and, therefore, requiring only low voltage wiring during installation.

Yet another object of the present invention is to provide an ion injector which can be installed independently in any air handling system regardless of the type of filter used.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

The invention according to one general aspect is an ion injector comprising a high voltage generator that operates from a low voltage supply,a connector for connecting power from a low voltage source to the high voltage generator, at least one or more ionizing needles connected to the high voltage output of the high voltage generator and means for attaching the unit on an air duct wall with the ionizing needle penetrating into the interior of the air duct.

In the present invention, the high voltage generator is preferably made narrow and slender and is an integral part of the ion injector. In this way, installation is made easy by requiring only a low voltage low current supply to the unit via a small ordinary plug. The ion injector described herein is provided with means for mounting it from the outside of an air duct through a small hole formed in the wall of the duct, and all wiring is also made outside the air duct thus making the unit ideal for retrofit use in air handling systems.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
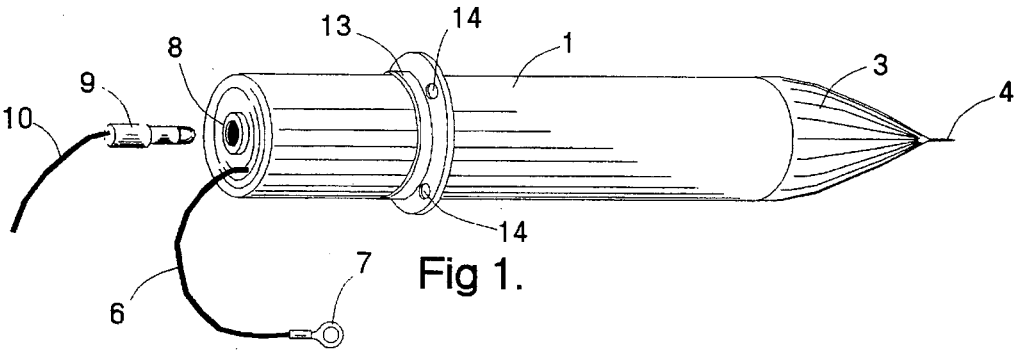
FIG. 1 is a drawing showing the ion injector in pictorial view.
Figure 2:
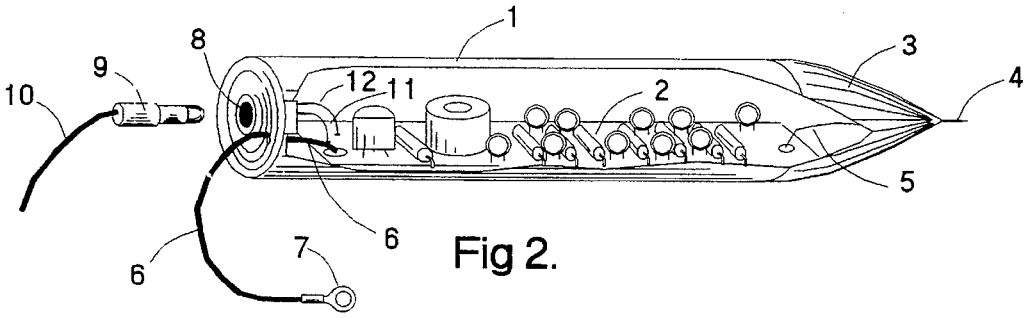
FIG. 2 is the same drawing as that of FIG. 1 but with a cut-out section to show the high voltage power supply and internal electrical connections.
Figure 3:
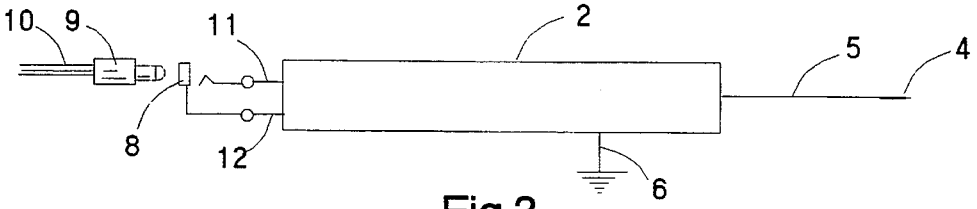
FIG. 3 shows the block diagram of the electrical connections to the ion injector.

In FIG. 1 and FIG. 2, the outside housing 1 of the injector houses high voltage generator 2. The housing 1 can be made of non-conducting plastic or it can be made of metal except for the cone 3 which holds ionizing needle 4. Cone 3 is made of non-conductive material in order to insulate the needle 4 from the rest of the housing 1. Ionizing needle 4 is connected to one output terminal of the high voltage generator 2 via wire 5. A wire 6 is connected to the other output terminal of high voltage power supply 2 and preferably grounded through the wall of the duct 20. A terminal 7 may be used to connect wire 6 to the duct 20 where the injector is installed.

A low voltage socket 8 connects low voltage power to the injector via a plug 9 and cable 10. Connecting wires 11 and 12 connect socket 8 to the input terminals of the high voltage generator 2.

Figure 4:
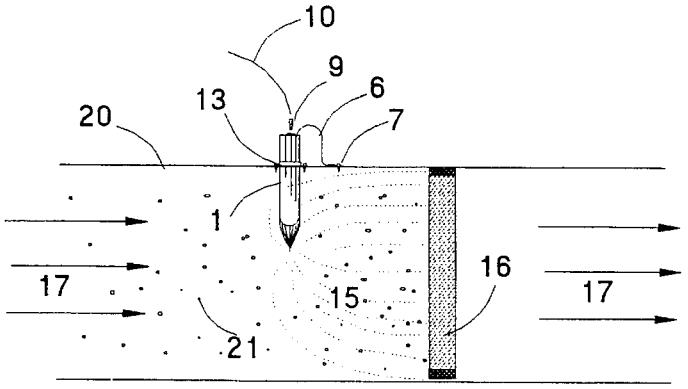
FIG. 4 shows a typical installation of the ion injector in an air duct.

An adjustable clamp 13 is located around the housing of the ion injector having tabs with holes 14 for mounting the injector onto a duct 20 (See FIG. 4). By changing the position of clamp 14 along housing 1 during installation on a duct 20, the depth of penetration of the injector into the duct 20 can be adjusted. This is desirable in order to locate ionizing needle 4 at about the center of the duct 20.

A typical duct 20 provides as part of its air handling system an air filter 16 somewhere in the duct 20 which carries air in the direction of arrows 17.

The operation of the ion injector is as follows: The injector is installed on an air duct 20 as shown in FIG. 4 via clamp 13 and powered by low voltage, typically 24 V, via cable 10, plug 9 and socket 8. The high voltage generator 2 produces high voltage, typically 10 KV between terminals 5 and 6. Terminal 6 is grounded to the duct by wire 6 and wire 5 supplies high voltage to needle 4. Needle 4 produces ionized charges 15 in the air because of the high potential gradient developed at its sharp end.

Charges 15 produced by needle 4 attach themselves to any particulate matter 21 in the air stream 17 which then becomes charged. These charged particles 21 are then more efficiently collected by filter 16 down stream.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property is claimed as follows:

1. An ion injection device for installation in an air duct which contains a particulate filter, comprising:

(a) a housing containing a high voltage generator that will operate when connected to a source of low voltage power;

(b) at least one ionizing needle carried by said housing and connected to the high voltage generator;

(c) means carried by said housing for receiving low voltage power to activate said high voltage power generator; and (d) means for attaching said ion injection device onto an air duct and positioning it with said needle protruding into the interior of the air duct;

wherein said high voltage power generator and said ionizing needle form an integral part of the ion injection device whereby, when said ion injection device is installed on the air duct with the ionizing needle protruding therein, and when low voltage power is connected to activate said high voltage generator, said ionizing needle will charge proximate particulate matter for more efficient removal of such particulate matter by a filter located downstream within the duct.

2. An ion injection device as described in claim 1 in which said housing is cylindrical and circular in cross-section.

3. An ion injection device as described in claim 1 in combination with an air duct containing a filter in which said ionizing needle is positioned within said air duct and said means for receiving low voltage power is located exterior to said duct.

4. An ion injection device as described in claim 1 in which said means for attaching said ion device onto an air duct is such that it enables the ionizing needle of said device to be positioned with various degrees of penetration into said duct.

* * * * *

UNITED STATES PATENT AND TRADEMARK OFFICE

CERTIFICATE OF CORRECTION

PATENT NO. : 5,518,531

DATED : May 21, 1996

INVENTOR(S) : Constantinos J. Joannou

It is certified that error appears in the above-identified patent and that said Letters Patent is hereby corrected as shown below:

On the title page, Item [75] change "Joannu" to read --Joanou-- .

On the title page, Item [75] inventor address should read:

93 Hobart Crescent
Nepean, Ontario.
Canada K2H 5S3

Signed and Sealed this

Third Day of April, 2001

*Attest:*

Nicholas P. Godici

NICHOLAS P. GODICI

*Attesting Officer*

*Acting Director of the United States Patent and Trademark Office*